US005359815A

United States Patent [19]

Schrunk, III et al.

[11] Patent Number: 5,359,815

[45] Date of Patent: Nov. 1, 1994

[54] PROFILE GRINDER

[75] Inventors: Robert R. Schrunk, III, Truman, Minn.; Harry Madison, Germantown, Tenn.; Michael B. Gilbert, Fairmont, Minn.

[73] Assignee: Harsco Corporation, Wormleysburg, Pa.

[21] Appl. No.: 972,014

[22] Filed: Nov. 6, 1992

[51] Int. Cl.[5] ..... B24B 23/00

[52] U.S. Cl. ..... 451/347; 451/360

[58] Field of Search ..... 51/166 R, 168, 170 R, 51/178, 177, 166 TS, 166 MH

[56] References Cited

U.S. PATENT DOCUMENTS

| | | | |
|---|---|---|---|
| 3,421,266 | 1/1969 | Schanafelt | 51/178 |
| 3,882,645 | 5/1975 | Duecker | 51/178 |
| 4,492,059 | 1/1985 | Panetti | 51/178 |
| 4,779,384 | 10/1988 | Shoenhair et al. | 51/178 |
| 4,993,193 | 2/1991 | Panetti | 51/178 |

FOREIGN PATENT DOCUMENTS

| | | | |
|---|---|---|---|
| 0304960 | 9/1989 | European Pat. Off. | 51/178 |
| 2661698 | 11/1991 | France | 51/178 |
| 0432263 | 11/1924 | Germany | 51/178 |
| 9108343 | 11/1990 | Germany | 51/178 |
| 2198673 | 6/1988 | United Kingdom | 51/178 |

*Primary Examiner*—Bruce M. Kisliuk
*Assistant Examiner*—B. Bounkang
*Attorney, Agent, or Firm*—Kerkam, Stowell, Kondracki & Clarke

[57] ABSTRACT

A rail maintenance vehicle includes a slide frame along which a grinder may move while the vehicle remains stationary. The grinder may be moved automatically away from the rail as the grinder moves longitudinally along the rail away from the center of a weld bead in order to smooth the grinding at the weld bead. The slide frame is connected by a linkage mechanism such that the grinder may be oriented at different grinding angles over a range of 200°. The grinder is mounted upon a lateral displacer such that the grinder may be moved from one side of the vehicle to the other for grinding on rails on either the right or left side of the vehicle. A turntable system allows the turntable cylinder to pivot up and out of the way to a horizontal position so that the lateral displacer may move the grinder from one side of the vehicle to the other without interference from a vertical turntable cylinder.

28 Claims, 10 Drawing Sheets

PROFILE GRINDER

BACKGROUND OF THE INVENTION

This invention relates to a profile grinder for grinding the profile of rails of a railroad track. More specifically, it relates to a profile grinder useful for grinding welded joints connecting rails of a railroad track.

Railroad rails are welded in place using several methods. These welded joints require grinding in order to produce a uniform surface. This process is most commonly performed with hand operated grinders. Although various configurations are used, most of the grinders used for smoothing welded joints on rails are mounted on rollers with manual control of the pressure applied to the grinding stone or wheel. Inconsistency of the surface and nicks in the rail surface due to lack of control result in areas of stress concentration which can and have resulted in catastrophic failure of the rail. Therefore, there is a need for improved accuracy in grinding such weld joints.

Various rail grinder vehicles have been used for grinding out distortions and surface irregularities in the rails of a railroad track. Among those prior designs is the rail grinder of U.S. Pat. No. 4,779,384 of Shoenhair, assigned to the assignee of the present application, and hereby incorporated by reference. The rail grinder vehicle according to that patent has four grinders mounted on each side of the vehicle, each grinder including a grind motor, a grindstone, and a feed jack for moving the grindstone against and away from a rail. The rail grinder of that patent is especially well suited for grinding long stretches of rails to smooth out the effects of long periods of use of the rails. As the vehicle moves along the rails, the four grindstones on each side may be simultaneously grinding the rails on each side of the track.

Although the Shoenhair design has been quite useful, there still exists a need for a smaller grinder vehicle for grinding to correct out of face problems and/or special problems at crossings and switches in the rails. Further, the range of orientations for the grindstone in the Shoenhair design is relatively good for the primary intended purpose of the Shoenhair grinder, but the range of orientations for the grindstone in the Shoenhair design does not include certain orientations which may be useful for grinding at specialized locations. The orientation of the grindstone in Shoenhair may be such that its lower surface is horizontal or is tilted towards the field side of the rail or tilted down towards the gauge side of the rail.

Various turntables have been used in numerous types of rail maintenance vehicles. Such turntables are used for rotating the vehicle relative to the rails so that the forward direction of the vehicle is changed from its previous orientation. Generally, such turntables are located near the center of the vehicle and include a hydraulic actuator which pushes a base against the roadbed in between the two rails of the railroad track. The base pushes down until the vehicle has been lifted off the rails. The operator and/or others then rotate the vehicle itself relative to the vertical shaft including the hydraulic actuator which extends from the base to the main frame of the vehicle. After the vehicle has been rotated 180° about the vertical axis corresponding to the turntable, the hydraulic actuator is retracted until the rail engagement wheels of the vehicle have reestablished contact with the rails of the railroad track.

Although such turntables have been generally quite useful, stability requirements make it advisable to place the turntable at or near the center of the vehicle or center of weight distribution of the vehicle. However, even when the hydraulic actuator is retracted such that the base is off the ground, it can limit one's ability to place certain rail maintenance mechanisms near the center of the vehicle.

OBJECTS AND SUMMARY OF THE INVENTION

Accordingly, it is a primary object of the present invention to provide a new and improved rail profile grinder.

A more specific object of the present invention is to provide a rail profile grinder especially well adapted to use with rail weld joints.

A further object of the present invention is to provide a rail grinder wherein the grindstone may be oriented over a wide range of positions so as to grind the top and side surfaces of the ball of the rail.

Yet another object of the present invention is to provide a turntable which may be moved to a position such that it avoids any interference with other parts of a rail maintenance vehicle.

The above and other features of the present invention which will be more readily understood when the following detailed description is considered in conjunction with the accompanying drawings are realized by a rail grinder vehicle. The rail grinder vehicle has a main frame with a front and a back and four rail engagement wheels supported thereon. A grinder support member is supported by the main frame. A grinder is mounted to the grinder support member. The grinder has a grindstone, a grind motor for rotating the grindstone, and a feed jack for moving the grindstone against and away from a rail. (As used herein, a grindstone is the grind wheel or other member which grinds against the rail, regardless of the material which it is made from.) Movement means are connected to the grinder support member for moving the grinder support member relative to the main frame in a line extending in a front to back direction such that the grindstone grinds in a path extending lengthwise along a rail as the main frame remains stationary. The longitudinal displacer preferably includes a carriage mounted to a carriage track extending in a front to back direction and a carriage mover for moving the carriage along the carriage track. A feathering actuator automatically moves the grindstone away from and toward a rail as the grindstone is moved longitudinally respectively away from and toward a center of a weld joint between rail sections. In other words, the feathering actuator moves the grindstone away from the rail as the grindstone moves longitudinally away from the center of the weld joint. As the grindstone is moved longitudinally toward the center of the weld joint, the feathering actuator moves the grindstone toward the rail. The carriage track is part of a slide frame. The feathering actuator moves the grindstone by moving the slide frame. A grinder angle positioner supported by the main frame and operably connected to the grinder support member is used such that the grinder angle positioner rotates the grinder about a longitudinal axis in the rail to grinding angles extending over a range from at least 95° on a field side of a rail through horizontal to at least 95° on a gauge side of a rail. The slide frame is rotated by the grinder angle positioner. The grinder angle positioner includes an actuator for rotating the grinder to different grinding angles, a drive link connected to the actuator, a first intermediate link connected to the drive link and an output link moved by the first intermediate link such that the output link in turn moves the grinder support member. More specifically, the output link is attached to the slide frame such that the slide frame moves with the output link. A lateral displacer is supported by the main frame and in turn supports the grinder support member for moving the grinder between right and left positions for grinding respectively on right and left rails. The slide frame is supported by the lateral displacer.

The present invention may alternately be described as a rail maintenance vehicle having a main frame, grinder support member, and grinder as discussed, together with a grinder angle positioner supported by the main frame and operably connected to the grinder support member such that the grinder angle positioner rotates the grinder about a longitudinal axis in the rail. The grinder angle positioner may rotate the grinder to grinding angles extending over a range from at least 95° on a field side of a rail through horizontal to at least 95° on a gauge side of a rail. Preferably, the range extends at least from 100° on the field side of the rail to 100° on the gauge side of the rail. The grinder angle positioner includes an actuator for rotating the grinder to different grinding angles, a drive link connected to the actuator, a first intermediate link connected to the drive link, and an output link moved by the first intermediate link such that the output link in turn moves the grinder support member. The intermediate link is a T link. The vehicle further includes a pair of arm links connected at opposite ends of the T link, and a cross link having opposite ends mounted to the arm links, the output link connected to the cross link.

The present invention may alternately be described as a rail maintenance vehicle having a main frame, grinder support member, and grinder as discussed above, together with a lateral displacer supported by the main frame and supporting the grinder support member for moving the grinder between right and left positions for grinding respectively on right and left rails. The lateral displacer includes a support frame mounted to the main frame for movement along a lateral track. The grinder support member is supported by the support frame, the support frame being movable between right and left positions. A slide frame is supported by the support frame. A grinder angle positioner connects the slide frame to the support frame. The vehicle may further include a turntable support pivotably mounted at a pivot to the main frame for pivoting about a horizontal axis, a hydraulic turntable cylinder having a first end mounted to the turntable support and a second end, and a turntable base mounted to the second end of the turntable cylinder. The pivot allows the turntable support to move between a lower position wherein the turntable cylinder is vertical for lifting the vehicle upon extension of the turntable cylinder such that the vehicle is turnable about a vertical axis corresponding to the turntable cylinder, and an upper position in which the turntable cylinder is non-vertical. The turntable cylinder and turntable base are sufficiently high when the turntable support is in its upper position such that the support frame is movable underneath the turntable cylinder and turntable base.

The present invention may alternately be described as a rail maintenance vehicle having a main frame with a front and a back and four rail engagement wheels supported thereon, a workhead support member supported by the main frame, a workhead for working on a track and mounted to the workhead support member, a turntable support pivotably mounted at a pivot to the main frame for pivoting about a horizontal axis, a hydraulic turntable cylinder having a first end mounted to the turntable support and a second end, and a turntable base mounted to the second end of the turntable cylinder. The pivot allows the turntable support to move between upper and lower positions as described. The workhead is preferably a grinder mounted to the workhead support member.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
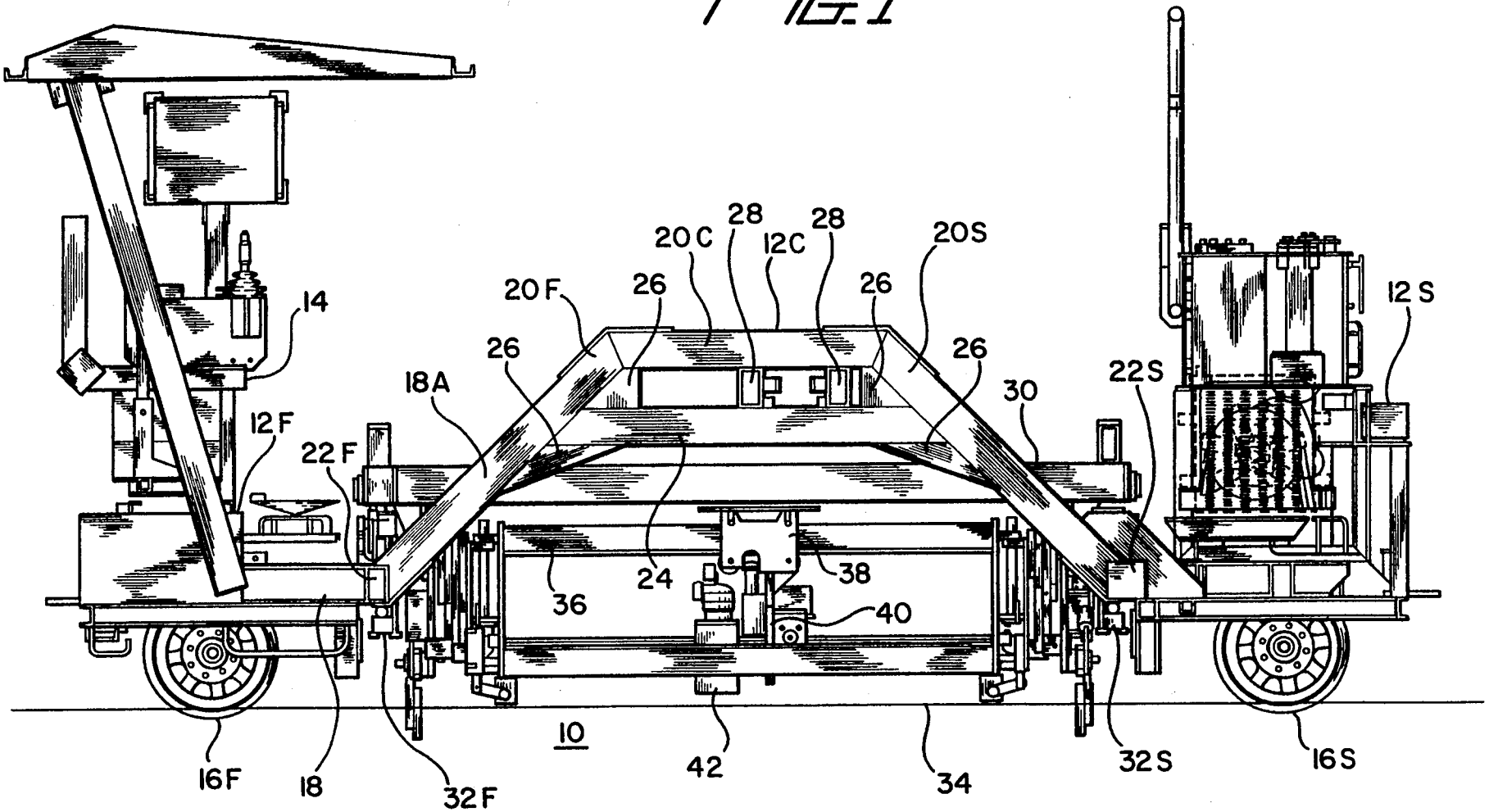
FIG. 1 shows a side view of the rail maintenance vehicle according to the present invention.

As shown in FIG. 1, the vehicle 10 of the present invention includes a first section 12F having an operator seat 14 and a first pair of wheels 16F and a second or front section 12S having a pair of back rail engagement wheels 16S connected by an axle (second wheel and axle not visible). The first section 12F and second section 12S of the vehicle 10 are relatively conventional and need not be described in detail, it being noted that they would include numerous hydraulic controls, an engine and propulsion system for the vehicle 10, a source of hydraulic fluid under sufficient pressure to supply the various hydraulic cylinders to be discussed below, a return tank for hydraulic fluid, and various other conventional structures. The vehicle 10 further includes a center portion 12C disposed between first and second sections 12F and 12S. A main frame 18 of the vehicle includes an arched portion 18A consisting of a pair of parallel first inclined members 20F, a pair of parallel horizontal members 20C, and a pair of second parallel inclined members 20S. In the view of FIG. 1, only one of each of the members 20F, 20C, and 20S is shown, it being understood that there is one of each of these members at the left side of the vehicle and one of each of these members at the right side of the vehicle. A first cross member 22F extends between the members 20F and a second cross member 22S extends between the members 20S. A pair of support braces 24 (only one visible in FIG. 1) extend between members 20F and 20S and various bracing members 26 may be used to increase the structural rigidity of the arch frame 18A, which structure is identical at its right and left sides. Two cross braces 28 extend between the pairs of members 20C.

The center section 12C is connected to the first section 12F by a pivot axle (not shown) of generally conventional construction which allows relative pivoting between the first section 12F and the remaining parts of the vehicle about a pivot axis extending longitudinally and centrally located between the two rails of the roadbed.

The work area of the machine is disposed between members 22F and 22S and the right and left sides of the arch frame 18A. Although the structures located within that work zone will be discussed in greater detail below, it is useful to briefly discuss the major components within that work zone as illustrated in FIG. 1. A support frame 30 is mounted to members 22F and 22S by way of first and second roller frames 32F and 32S. The roller frames 32F and 32S allow the support frame 30 to be moved between the right side of the vehicle 10 and the left side of the vehicle 10 for grinding on rails on either side of the track. The support frame 30, together with numerous other structures which are supported by it, may be raised and lowered relative to the two roller frames 32F and 32S such that the various structures mounted on the support frame 30 may be moved up and away from the rails 34 (top of one rail only shown) so that the vehicle 10 may be moved along the rails without the various structures supported by support frame 30 contacting the rails. In other words, the structures would only be lowered when it was desired to use the structures for grinding on the rails.

Mounted to the support frame 30 is a slide frame 36 having a carriage 38 disposed thereon for movement in a longitudinal (i.e., parallel to the rails of the track) direction. Mounted to the carriage 38 is a grinder support member 40 having a grinder 42 mounted thereon.

Figure 2:
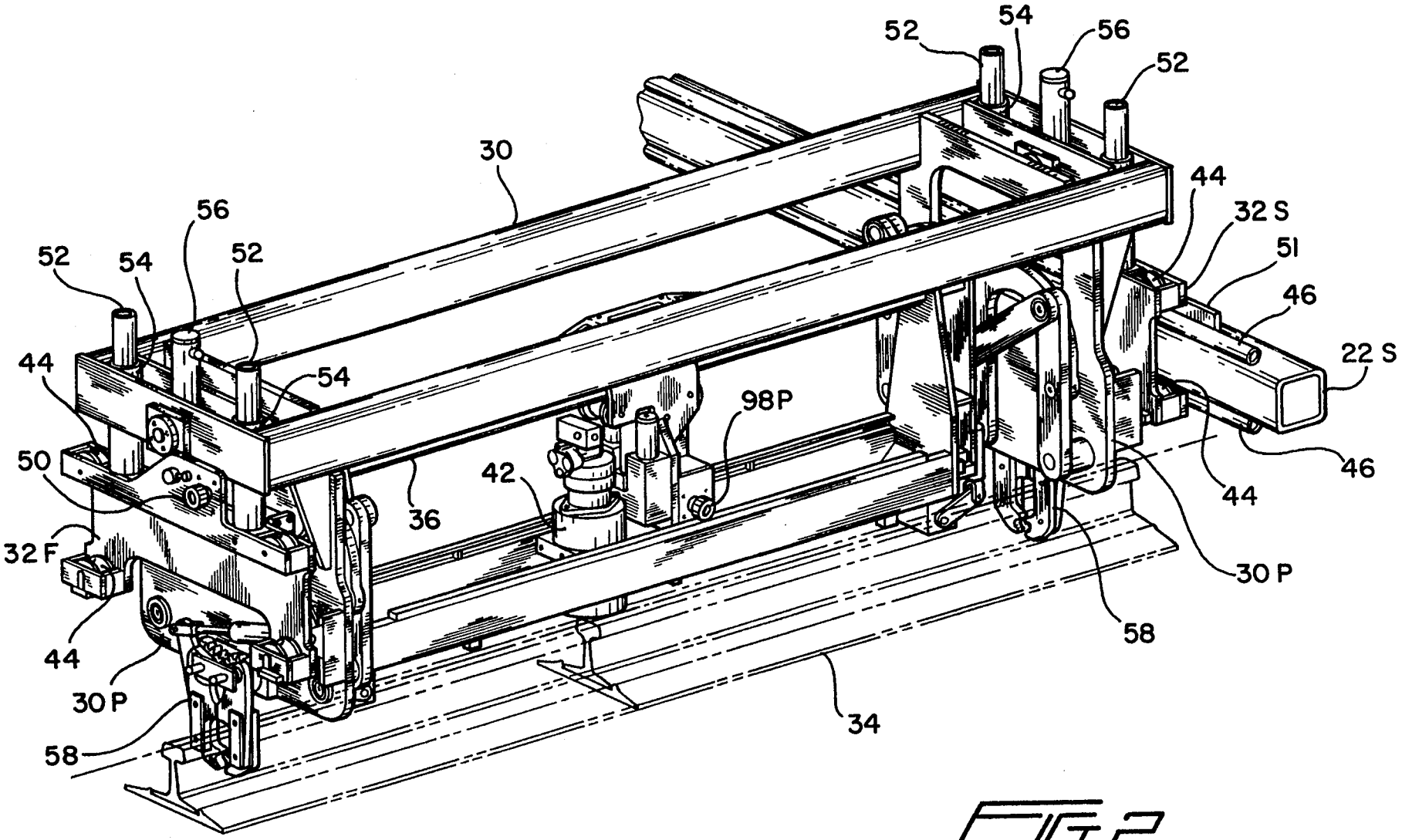
FIG. 2 shows a perspective view of a workhead carriage and associated parts.
Figure 3:
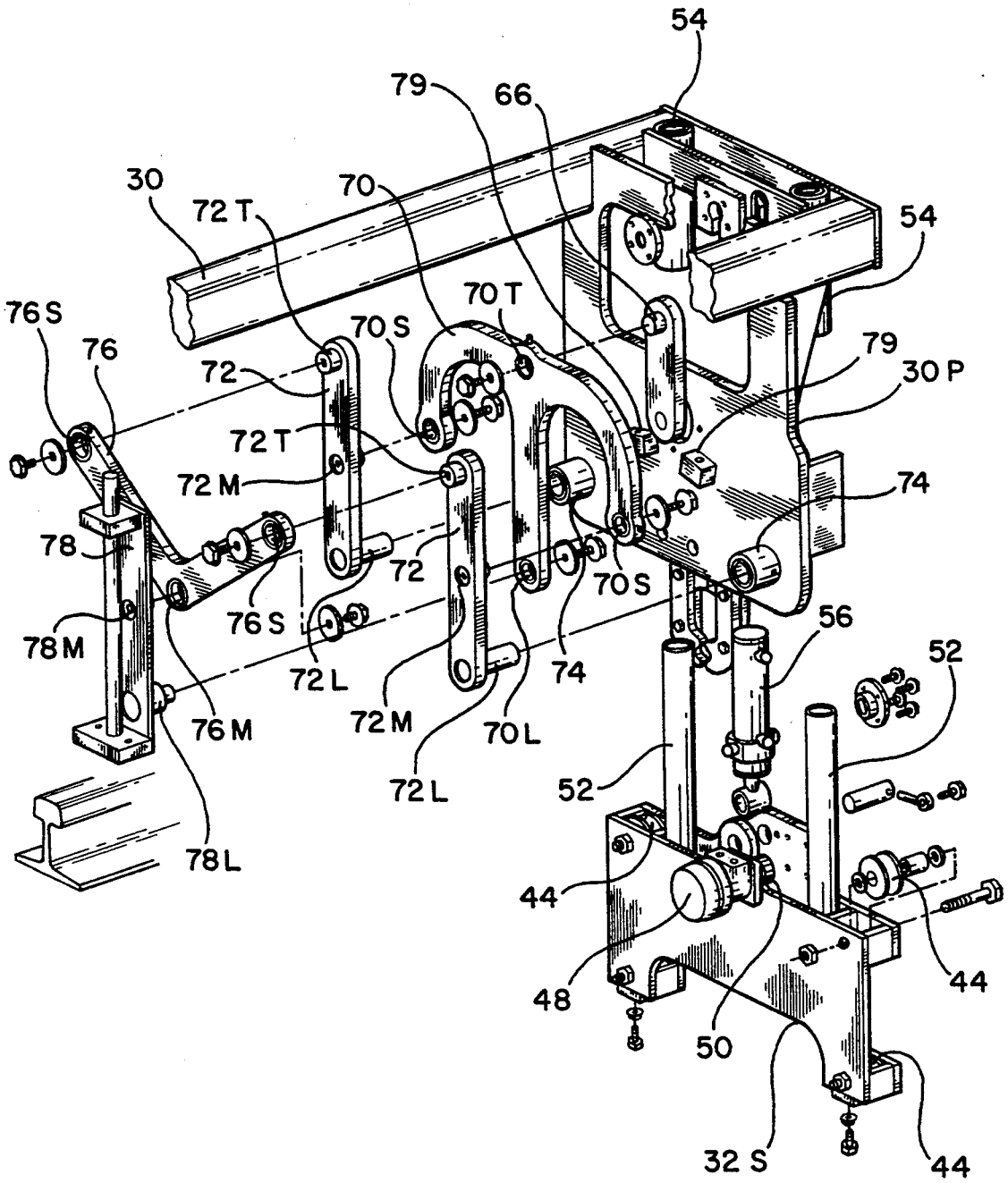
FIG. 3 shows an exploded perspective view of parts at one end of the workhead carriage.
Figure 4:
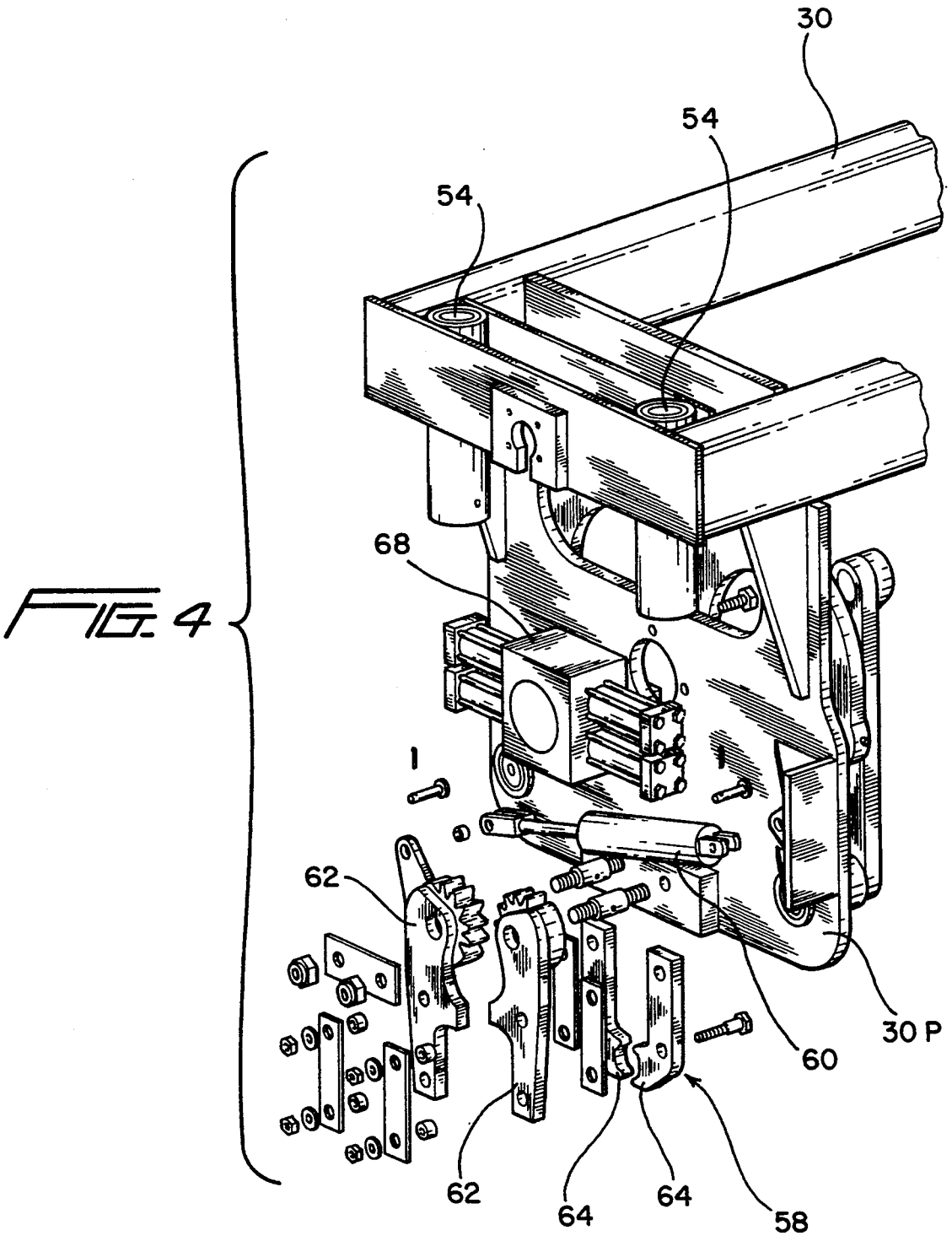
FIG. 4 shows an exploded perspective view of the end of the work carriage opposite to the end shown in FIG. 3.

With reference now to FIGS. 2, 3, and 4, the details of construction of the support frame 30 and roller frames 32F and 32S will be discussed, it being understood that roller frames 32F and 32S are identically constructed and that the support frame 30 has symmetric constructions at its front and back ends.

As best shown in FIG. 3, roller frame 32S has four rollers 44 (only three visible in FIG. 3), one of the rollers 44 located at each of the four corners of roller frame 32S. Each of the rollers 44 has a concave portion which mates with the curvature of tubes 46 which are fixed to the top and bottom of cross member 22S as shown in FIG. 2. (Member 22F of FIG. 1 would be constructed in similar fashion to 22S.) The roller frame 32S is moved between the right and left sides of the vehicle by use of a motor 48 powering a pinion. The pinion 50 moves the roller frame 32S by contacting a rack gear 51 which is mounted on the top surface of member 22S, parallel to and behind the upper one of the tubes 46 in FIG. 2. Slide tubes 52 are mounted to the roller frame 32S for sliding engagement with tubes 54 mounted to the support frame 30. A hydraulic lift cylinder 56 is secured at an upper end to the support frame 30 and is bolted at its lower end to the roller frame 32S. Accordingly, when the lift cylinder 56 is extended, support frame 30 will be lifted up and the associated structures mounted to support frame 30 will be clear of the rails. However, when it is desired to work on the rails, the lift cylinder 56 will be retracted such that support frame 30 will be lowered.

The support frame 30 includes plates 30P at opposite ends thereof. Each of the plates 30P has a rail clamp assembly 58 mounted thereon. The rail clamp assembly 58 is used to clamp the support frame 30 to the rail 34 before grinding a weld joint in the rail. As shown in FIG. 4, the rail clamp assembly 58 may be of generally conventional construction including an actuating cylinder 60 used to rotate two members 62 (one of which is rotated directly, while the other is rotated by way of rotation of the first), each of the members 62 having pinions mounted thereon. Rotation of the members 62 in turn rotates the pair of jaws 64 in order to clamp the rails.

While the support frame 30 and roller frames 32F and 32S serve as a lateral displacer for moving the grinder 42 from a position where it works on one rail to a position where it works on the rail opposite the first rail, the slide frame 36 is used as a longitudinal displacer for moving the grinder 42 along the rail 34. Before discussing the details of the slide frame 36 and the mounting of the grinder 42 thereon, a linkage structure used to connect the slide frame 36 to the support frame 30 will be discussed primarily with reference to FIG. 3.

A drive link 66 is pivotably mounted to the end plate 30P. The drive link 66 will rotate about a horizontal axis at its lower end when driven by an actuator (not visible in FIG. 3, but see identical actuator 68 mounted at other end plate 30P of FIG. 4). The drive link 66 in turn has its upper end pivotably connected to T link 70 at top pivot 70T. Two parallel links 72 are pivotably connected at their midpoint 72M at side points 70S of the T link 70. Each of the parallel links 72 have lower shafts 72L which are pivotably disposed within sleeves or bearings 74 a boomerang link 76 has opposite sides 76S connected pivotably to shafts 72T extending from the top of parallel links 72. The boomerang link 76, so named because of its shape, has a middle point 76M which is pivotably connected to a midpoint 78M of an output link 78. The output link 78 has a lower pivot 78L which is pivotably connected at the lower part 70L of the T link 70.

Figure 7:
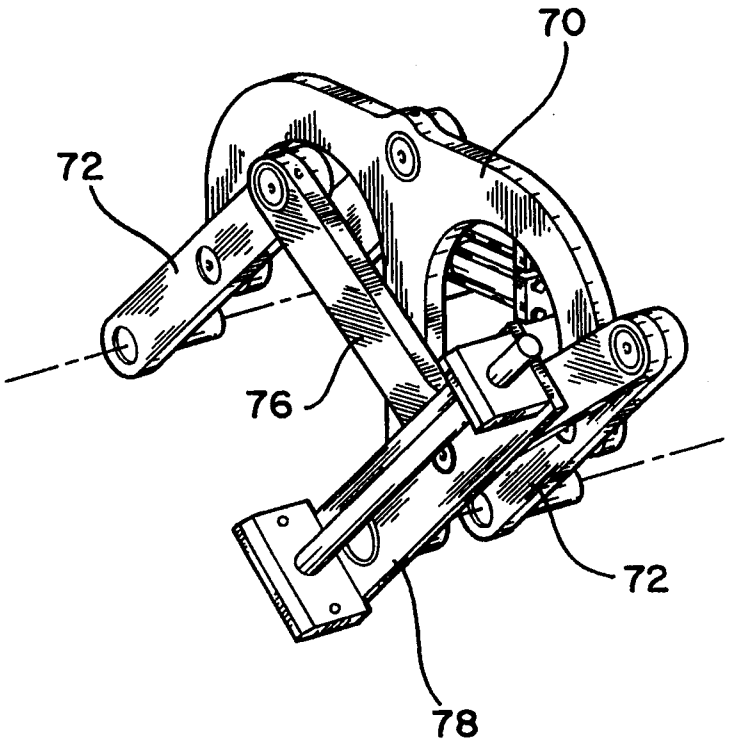
FIG. 7 shows the linkage structure oriented in a position corresponding to a 45° head rotation from the position of FIG. 6.
Figure 6:
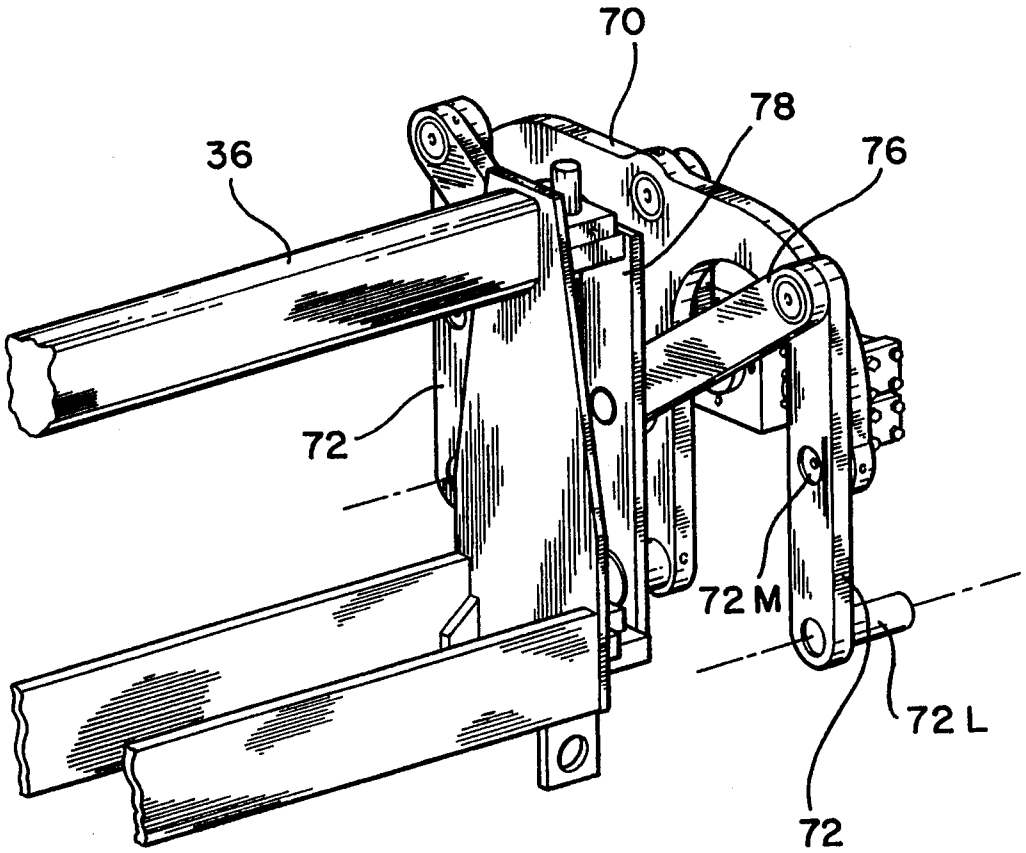
FIG. 6 shows a perspective view of one end of the slide frame in a position corresponding to a vertical head position (i.e., a grindstone on the workhead would be oriented for horizontal grinding on the top surface of the rail) together with an associated linkage structure.

Continuing to view FIG. 3, but also looking at FIGS. 6 and 7, the output link 78 determines the orientation of the slide frame 36 (FIG. 6 only) as the drive link 66 (FIG. 3 only) moves over a 200° range (defined between stops 79), the output link 78 will in turn move over a 200° range. Accordingly, the slide frame 36 will move over that 200° range and the grinder (not shown in FIGS. 3, 6, or 7) which is mounted to the slide frame 36 will in turn rotate to change its grinding angle. The linkage arrangement is used so that the output link 78 and in turn the grinder will rotate about a longitudinal (i.e., front to back) axis centered in the upper part of the ball of the rail. Thus, the rotary hydraulic actuators (68 in FIG. 4) allow one to control the grinding angle by way of the linkage arrangement.

Figure 5:
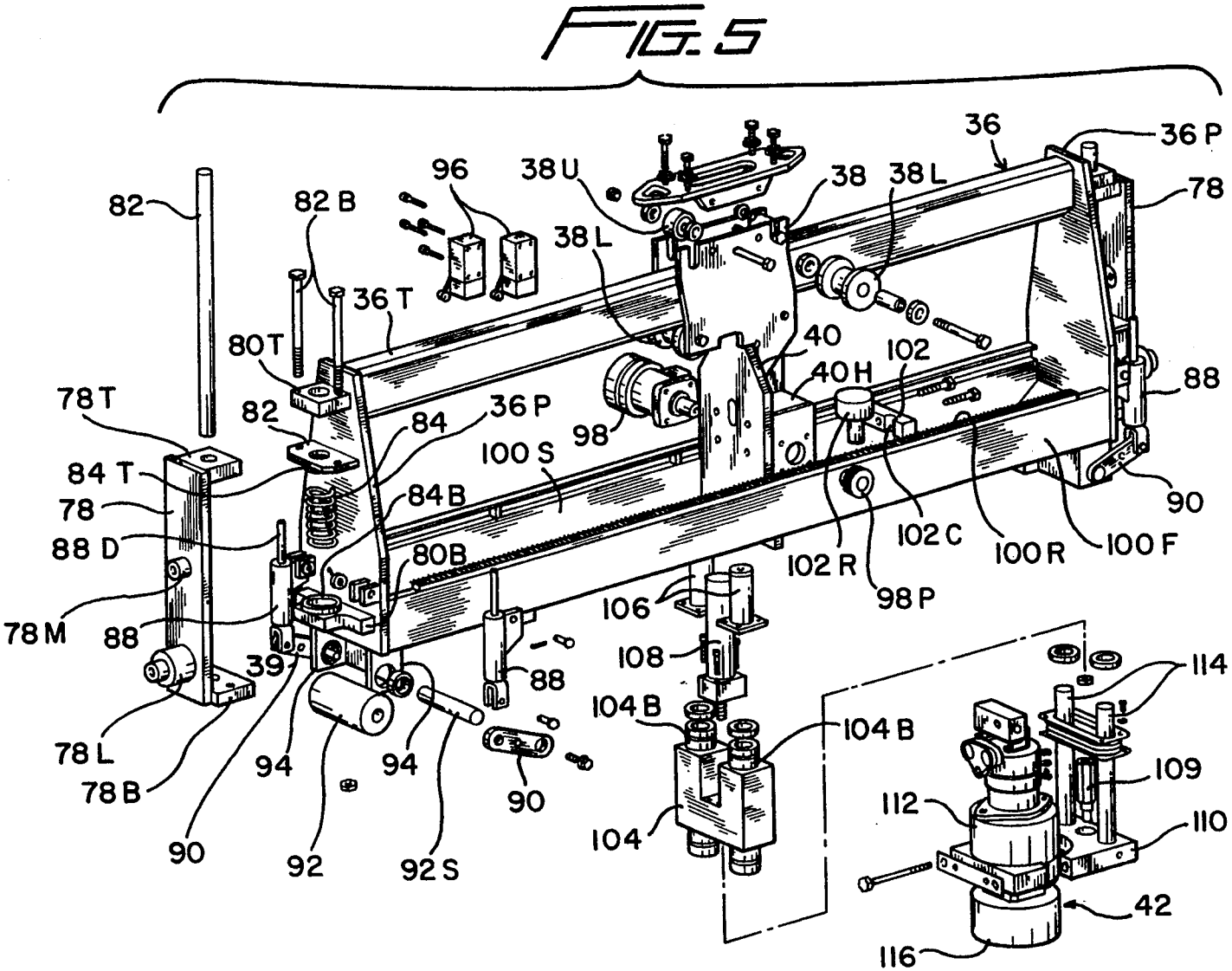
FIG. 5 shows a slide frame and associated parts.
Figure 5A:
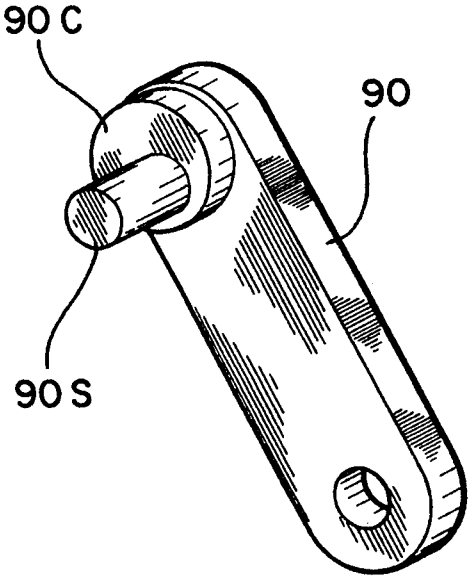
FIG. 5A shows a perspective view of a cam link of FIG. 5.
Figure 5B:
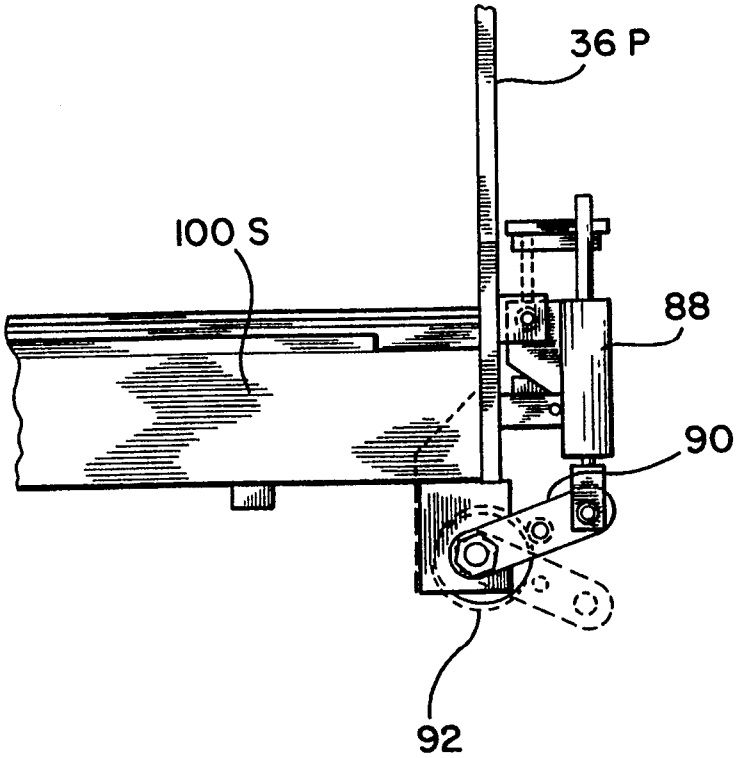
FIG. 5B shows a simplified side view of the structure of FIG. 5.

Turning now to FIG. 5, the output links 78 are movably connected to opposite plates 36P of the slide frame 36. Specifically, top block 78T of output link 78 is captured just under top block 80T of end plate 36P by guide shaft 82. The guide shaft 82 extends through top block 80T, top block 78T, plate 82, spring 84, bottom block 80B of plate 36P and bottom block 78B of output link 78 in that order. A cap screw (not shown) or other arrangement may be used at one or both ends of guide shaft 82 to insure that it does not slip out of the various holes through which it proceeds. The plate 82 is fixed relative to the lower block 78B by bolts 82B with plate 82 and lower block 78B on opposite sides of the lower or bottom block 80B. The spring 84 sits within opposing tubes 84T and 84B respectively disposed on the underside of 82 and the top side of 80B. Accordingly, the spring 84 pushes block 80B downward relative to the plate 82, thereby biasing or pushing the slide frame 36 downward (i.e., in the view of FIG. 5) relative to the output link 78. The components used for connecting output link 78 to the plate 36P are shown for the left plate 36P in FIG. 5, but it will be readily understood that identical structures are disposed at the opposite end of slide frame 36. Each plate 36P has two feathering actuator cylinders 88 having upper ends pivotably connected to the plate 36P. A dummy rod 88D is at the top of the actuator 88 and is simply used to provide equal volumes within the cylinder above and below the piston disposed within the cylinder. The rod end of the cylinder or actuator 88 is pivotably connected to a cam link 90. Extending between the two cam links 90 at each end of slide frame 36 is a roller 92 captured between the cam links 90 and pivotably mounted to stub shafts 90S at each end. Spacer shaft 92S is connected to the middle of the cam links 90, and the roller 92 is movable up and down relative to slide frame 36 by (see FIG. 5A) virtue of the rotation of cam part 90C (free to rotate in hole at part 94 of slide frame 36) in the hole in part 94 (FIG. 5 only) which rotates stub shafts 90S off center to rotate roller 92 off center as stub shafts 90S extend into roller 92. As shown in FIG. 5B, the roller 92 moves up and down about 0.22 inches under control of the feathering actuators 88.

The spring 84 allows some movement of the slide frame 36 relative to the output link 78 so as to compensate for the fact that the top of the rail is not a perfect circle. The rollers 92 will contact the rail (not shown in FIG. 5) and control the separation distance between slide frame 36 and the rail. Specifically, as the feathering actuator cylinders 88 are extended, roller 92 is moved down (in the view of FIG. 5) relative to slide frame 36 such that the separation distance between slide frame 36 and the rail is increased. When feathering actuators 88 are retracted, roller 92 is moved up to decrease the separation distance between slide frame 36 and the rail. Since there is one roller 92 and two leathering actuators 88 at each end of the slide frame 36, adjustments at each of the ends of slide frame 36 may be used to move the grinder 42 further into the rail or back it away from the rail. The arrangement for controlling leathering actuators 88 will be discussed in more detail below, but it should be noted that the leathering actuators 88 are used to automatically back the grinder 42 away from the rail as the grinder 42 is moved longitudinally away from the center of a weld bead on the rail. This tends to grind more at the center of the weld bead and less at its edges so as to smooth the transition between two rail sections which are field welded together.

Continuing to view FIG. 5, the carriage 38 has two upper rollers 38U (only one visible) and two lower rollers 38L which respectively travel along the top and bottom of the slide frame track 36T. Limit switches 96 may be mounted on the carriage 38 or on the slide frame track 36T and are used to operate hydraulic valves (discussed below) upon movement of the carriage 38 longitudinally from the center of the track 36T.

The grinder support member 40 is fixed for movement with the carriage 38 and includes a motor housing portion 40H in which a motor 98 is disposed. The motor 98 powers a pinion 98P which engages a rack gear 100R for moving the grinder support member 40 longitudinally between opposite side members 100F and 100S of the slide frame 36. The motor 98 moves the grinder support member 40 by moving the carriage 38 along its track 36T.

Fixed to the right of housing portion 50H is a member 102 having two cavities 102C (only one visible) disposed therein for capturing lower shafts of two rollers 102R (only one visible). The roller 102R which is illustrated would be free to rotate relative to the grinder support member 40 and is disposed in the cavity 102C. The roller 102R which is illustrated would, upon the slide frame 36 being tilted clockwise about a longitudinal (parallel to track 36T) axis support the weight of grinder 42 and grinder support member 40 against the surface of member 100F which faces towards member 100S. In similar fashion, the second roller 102R which is not shown but which would sit within a non-illustrated cavity 102C supports the grinder 42 and grinder support member 40 against the inner surface of member 100S when the slide frame 36 is rotated counterclockwise about a longitudinal axis. In other words, the weight of the grinder 42, motor 98, and grinder support member 40 is usually carried by the carriage 38 and its associated wheels 38U. However, when the slide frame 36 is rotated from its illustrated vertical position of FIG. 5, the rollers 102R are used to bear some of the weight against the inside surface of either member 100F or 100S.

A bearing block 104 is fixed to the exposed face of grinder support member 40 and includes two ball bush bearings 104B to which corresponding cover assemblies 106 are mounted. A grinder feed cylinder 108 of grinder 42 is fixed to the bearing block 104 and has its rod end extending into a stud 109 secured to plate 110 having the grind motor assembly 112 fixed thereto. Guide shafts 114 slide within bearing tubes 104B when the feed hydraulic cylinder 108 is extended or retracted in order to move grindstone 116 toward or away from the rail.

Figure 8:
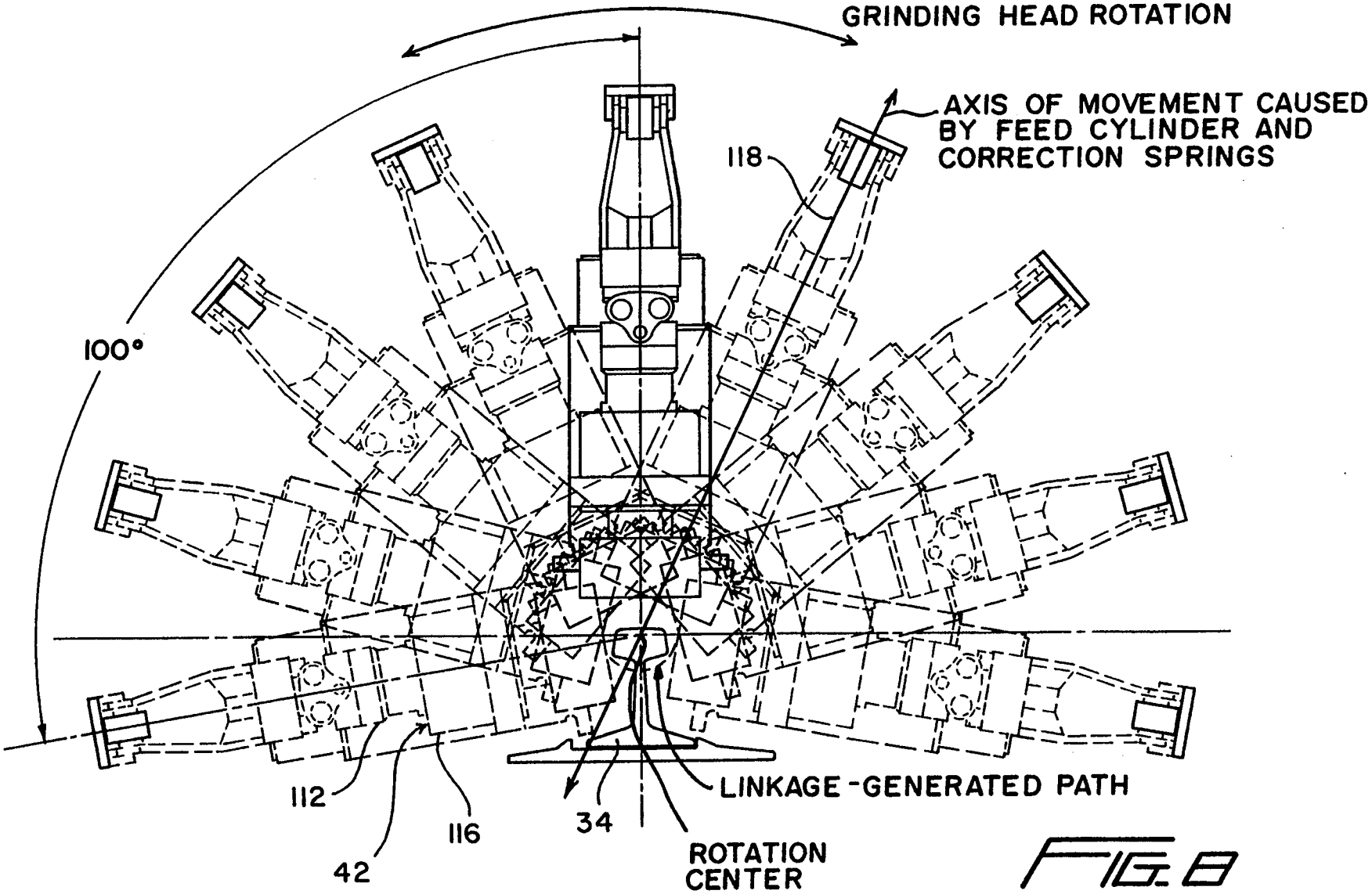
FIG. 8 shows different positions for the grinder as the linkage of FIGS. 6 and 7 (also shown in FIG. 3) is rotated over its full range of movement.

Referring back momentarily to FIG. 3, the linkage arrangement having link 66 connected to output link 78 by the various intermediate links allow the grindstone 116 to assume the various grinding angles illustrated in FIG. 8 extending over a range from 100° on the field side of the rail through horizontal (where the grindstone lower surface is horizontal) to 100° on the gauge side of the rail. FIG. 8 shows the linkage generated path as a portion of a circle centered about a rotation center just below the top surface of the rail 34. FIG. 8 also shows the axis 118 of movement caused by the feed cylinder and correction springs for a particular orientation of the grinder 42. The path illustrated in FIG. 8 corresponds to the output link 78 (see FIG. 3) moving over a 200° range by rotation about the same rotation center shown in FIG. 8. This is a direct rotation about the longitudinal axis in the rail corresponding to the rotation center of FIG. 8, in that, as shown, the rotation is not about some other center which is translated (linear motion).

Briefly considering FIG. 3 in conjunction with FIGS. 6 and 7, it should be noted that the distance between 72M and 72L on each of the parallel links 72 is the same as the distance between the rotation axes at the upper and lower ends of drive link 66 such that, as especially illustrated in FIG. 7, T link 70 and boomerang link 76 will maintain their orientation as rotation of the drive link 66 causes them to move.

Figure 9:
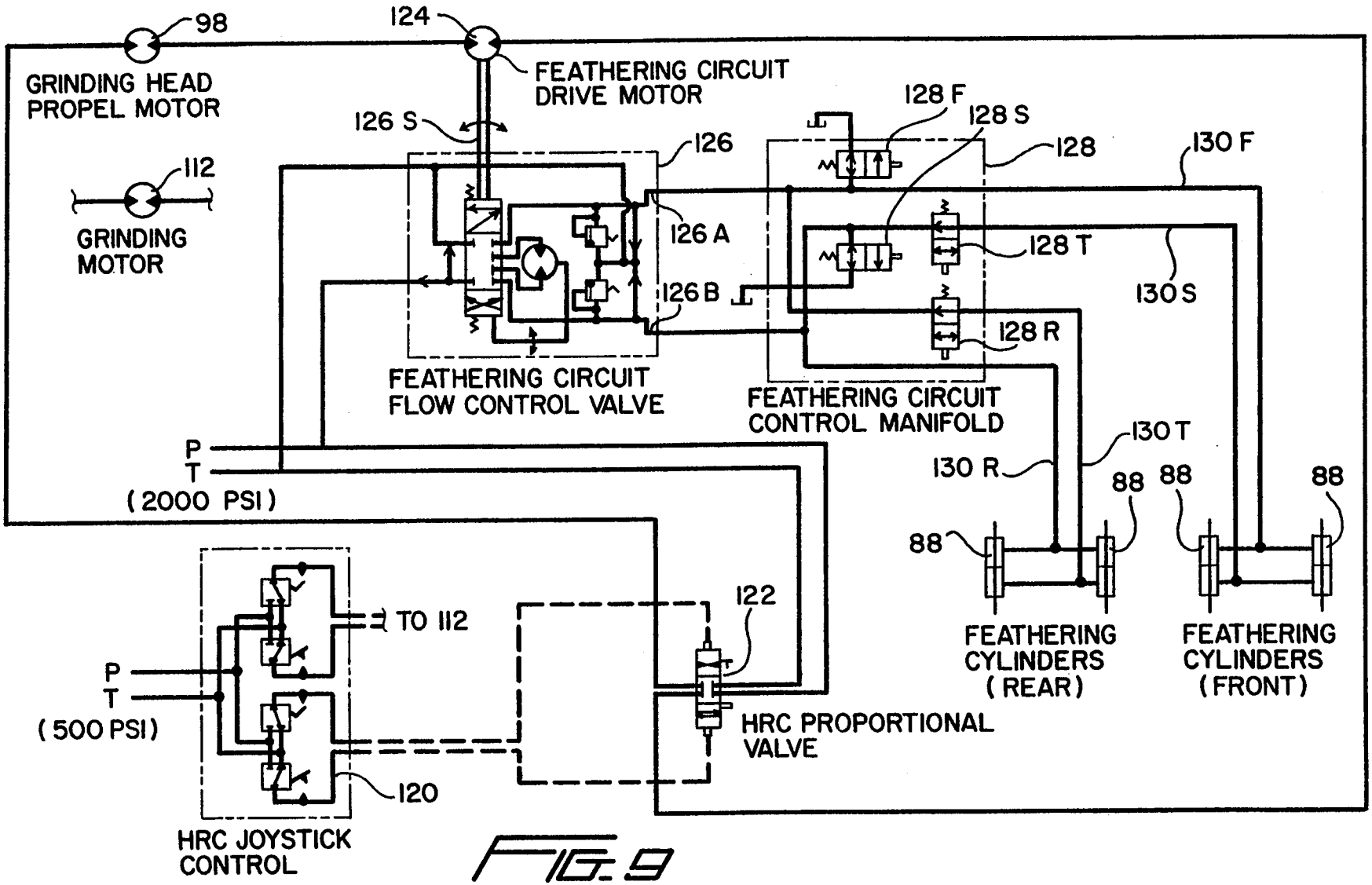
FIG. 9 is a simplified hydraulic circuit schematic showing how a feathering feature of the present invention is realized.

Turning now to FIG. 9, a hydraulic circuit is shown to illustrate how the feathering is accomplished. The hydraulic motor 98 (refer back momentarily to FIG. 5) which moves the grinder 42 along the rail is controlled by a joystick control 120 acting through a proportional valve 122. The joystick control 120 is connected to pressure (P) and return or tank (T) lines. The operator uses the joystick 120 (hydraulic remote control—HRC) to move the grinder 42 (not shown in FIG. 9, refer to FIG. 5) in a longitudinal direction. In order to control the feathering cylinders 88 so that they lift the grinder 42 away from the rail as one moves the grinder 42 longitudinally away from the center of a weld bead, a feathering circuit drive motor 124 is connected in series with the motor 98. The feathering circuit drive motor 124 is connected to the input shaft 126S of a hydraulic steering unit 126, which may for example be a unit commercially sold under the trademark ORBITROL. The direction of rotation of shaft 126S determines whether hydraulic fluid, such as oil, is supplied out of port 126A or port 126B of the unit 126. The speed of rotation of shaft 126S determines the magnitude of flow supplied out the selected port. Both ports 126A and 126B are connected by a feathering circuit control manifold 128 having first, second, third, and fourth poppet valves 128F, 128S, 128T, and 128R. Lines 130F, 130S, 130T, and 130R carry hydraulic fluid to the various feathering cylinders 88. As shown, the front feathering cylinders are separately connected from the rear feathering cylinders. This relates to the front and rear of the slide frame 36 (refer back to FIGS. 2 and 5). As indicated in FIG. 9, the joystick control 120 would also control the grinding motor 112.

The operation of the feathering feature of the present invention may best be understood by considering FIGS. 2, 5, and 9 together. Initially, the operator of the vehicle would stop the vehicle so that the slide frame 36T is centered approximately at the center of a weld bead on a rail (not shown). Having stopped the vehicle, the roller frames 32F and 32S (refer momentarily to FIG. 3 as well) would either already by over the rail upon which grinding is to be performed or the roller frames would be moved (motor 48 of FIG. 3 and similar unshown motor at opposite end) until the roller frames are at the proper side of the track. The hydraulic cylinders 56 are retracted in order to lower the support frame 30 adjacent to the rail 34 of FIG. 2. The actuators 68 (one shown in FIG. 4, similar one would be at opposite end of support frame 30) rotate the slide frame 36 to the appropriate angle within the angular range corresponding to FIG. 8. When the grinding angle is properly set, the operator may operate feed cylinder 108 and motor 112 to apply the grindstone 116 to the rail and begin grinding. Next, control 120 is operated to supply hydraulic fluid to the grinding head propel motor 98 to rotate pinion 98P such that the grinder 42 moves along as the carriage 38 moves on track 36T. Initially, and with grinder 42 and near the center of the slide frame 36, the drive motor 124 operates the hydraulic steering unit 126, but valves 128F and 128S supply any hydraulic fluid from ports 126S and 126B back to the tank of the hydraulic system and valves 128T and 128R are in a blocking mode. In other words, the feathering cylinders 88 are not engaged or operated. However, when the carriage 38 and grinder 42 have moved sufficiently in one direction along track 36T, one of the limit switches 96 will be engaged so as to operate valves within the manifold 128. If the carriage 38 and grinder 42 are being moved toward the rear of the slide frame 36 (the rear of the vehicle), the manifold 128 will cause operation of the two rear feathering cylinders 88 of FIG. 9. Specifically, the valves 128F and 128S will block hydraulic flow to the return tank, whereas the valve 128R will allow fluid flow. The valve 128T will remain in a blocking condition. Importantly, since the feathering circuit drive motor 124 is connected in series with the grinding head propel motor 98, the amount of change in the rear feathering cylinders 88 will increase as the grinder 42 moves further from the center of the weld bead. Specifically, the hydraulic steering unit 126 will move the roller 92 (see FIG. 5) at the rear end of slide frame 36 toward the rail. Since the roller 92 will already be touching the rail, this will move the rear of slide frame 36 away from the rail. Therefore, the grindstone 116 will be lifted slightly away from the rail and will grind less on the rail as the grinder 42 travels further from the center of the weld bead. When the operator adjusts control 120 to cause grinding head propel motor 98 to move the grinder 42 back towards the center of the weld bead, the feathering circuit drive motor 124 will slowly reverse the activation of the rear feathering cylinders 88 so as to retract the feathering cylinders and move the rear roller 92 closer to the slide frame 36. As the slide frame is biased toward the rail, by the spring 84, retracting the rear feathering cylinders 88 to retract the roller 92 closer to the slide frame 36 returns the slide frame 36 to its position closer to the rail as the grinder 42 passes the limit switch 96 and all of the feathering cylinders are disconnected from hydraulic steering unit 126 as valve 128R returns to a blocking condition and valves 128F and 128S return to a condition of allowing free flow of fluid back to the return or tank of the hydraulic system. As the operator continues to move the grinder 42 towards the front of the vehicle, the carriage 38 will pass the other limit switch 96 at which time the valves 128F and 128S will assume a blocking condition and the valve 128T will begin allowing fluid flow. The front feathering cylinders 88 will then be connected to the hydraulic steering unit 126 and will operate in the same fashion as discussed with respect to the rear feathering cylinders. Accordingly, the amount of grinding is smoothly reduced as the grinder travels further from the center of the weld bead. For a particular weld bead, the grinder may make numerous passes at different grinding angles over the range illustrated by FIG. 8.

Figure 10:
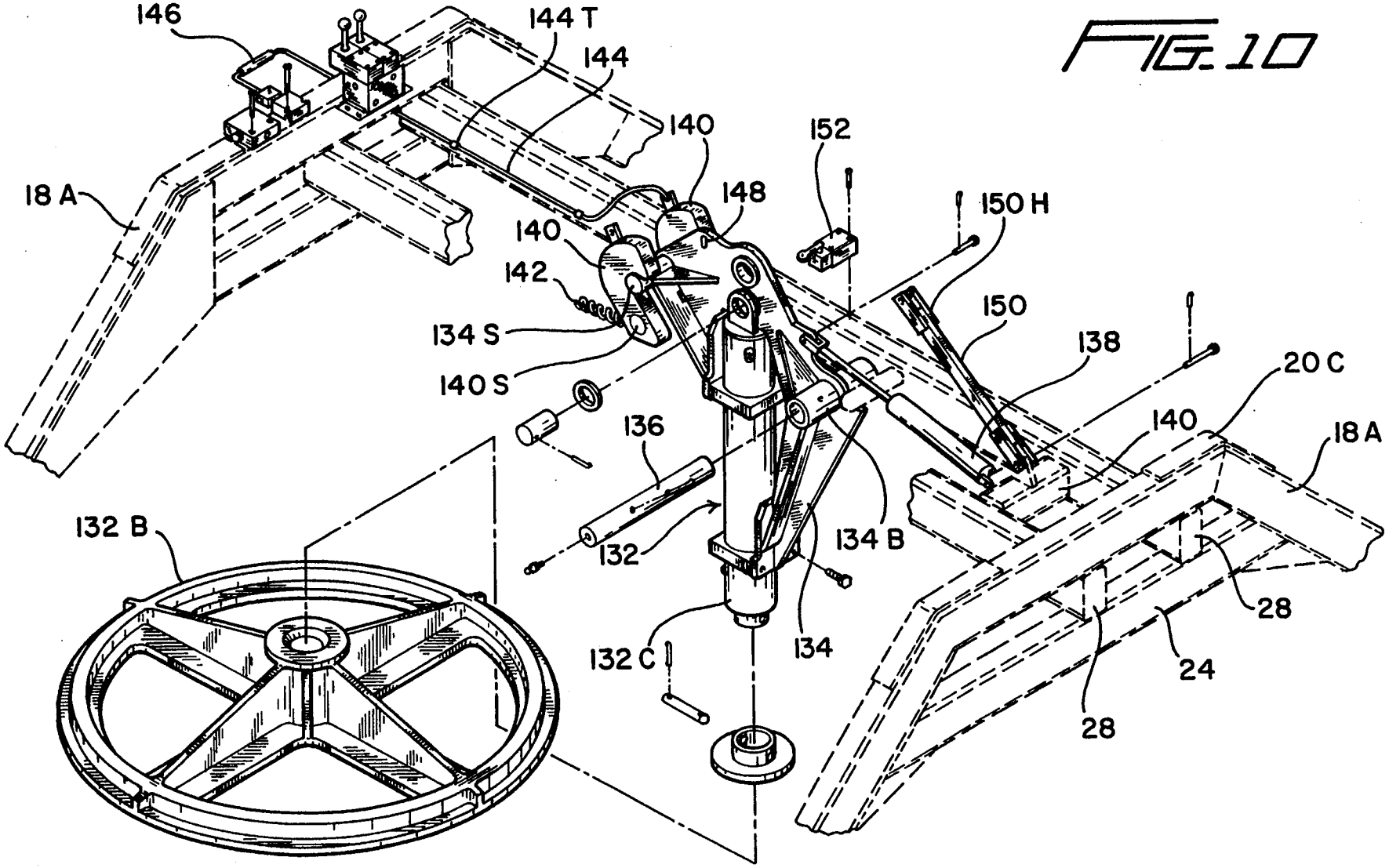
FIG. 10 is a perspective exploded view showing how a turntable assembly mounts to a main frame of the vehicle.

Turning now to FIG. 10, a unique turntable arrangement of the present invention will be discussed. The turntable 132 is pivotably mounted upon the cross beams 28 extending between the arch frames 18A. In particular, the turntable 132 includes a hydraulic cylinder 132C having a base 132B fixed on its bottom. The hydraulic cylinder 132C is fixed to a mounting bracket 134 having a bearing sleeve 134B into which a shaft 136 extends. The shaft 136 extends through the bearing sleeve 134B and out into corresponding holes (not shown) disposed in the two parallel cross beams 28. Accordingly, the bracket 134 and the turntable 132 are mounted to the two parallel beams 28.

A hydraulic cylinder 138 is connected between member 140 (which in turn extends between beams 28) and the bracket 134. When the cylinder 138 is extended, the bracket 134 rotates counterclockwise so that the cylinder 132C moves into the vertical position as shown. In that vertical position, the cylinder 132C may be extended to lower the base 132B so as to rest upon the ballast (not shown) in between the rails of the roadbed. Upon cylinder 132C being sufficiently extended, the base 132B will be supporting the whole vehicle and the wheels (not shown in FIG. 10) will have been lifted off the rails. One or more persons may then rotate the vehicle so that it can reverse its forward direction relative to the track. Upon rotating the vehicle 180° about a vertical axis corresponding to the vertical turntable cylinder 132C, the cylinder 132C may be retracted until the vehicle wheels are again on the rail and the base 132B is lifted off the roadbed.

In order to provide better support for the turntable 132 when lifting the vehicle, bracket 134 includes shafts 134S on opposite sides (only one visible in FIG. 10). Each of the shafts 134S engages a hook-like shaped latch 140 each of which is pivotably connected to a corresponding cross beam 28 by a shaft (not shown) which extends into holes 140S and corresponding holes (not shown) on opposing faces of the two cross beams 28. Separate springs 142 (only one shown) separately bias the latches 140 clockwise (i.e. about an axis extending horizontally through the horizontal hole 140S). In the position shown in FIG. 10, shaft 136 and the shaft in holes 140S will both bear some of the load when the cylinder 132C is lifting the vehicle. However, the turntable 132 must be moved out of the way in order to allow the support frame 30 (refer back momentarily to FIG. 2) to be moved along beam 22S from one side of the vehicle to the other side of the vehicle. Accordingly, a cable 144 having a handle 146 is used to disengage the latches 140 from the shafts 134S. Although only a portion of cable 144 is shown, it would extend through a series of small tubes 144T in a loop from one of the latches 140 to the handle 146 and on to the other of the latches 140. When one wished to free the shafts 134S from the latches 140, the handle 146 is pulled and the two latches 140 are moved counterclockwise from the position of FIG. 10. The hydraulic cylinder 138 is then retracted causing the rotation of bracket 134 and associated turntable 132 clockwise about an axis corresponding to shaft 136. The turntable 132 is pivoted clockwise about that horizontal axis until the cylinder 132C is horizontal and a safety hole 148 in bracket 134 lines up with corresponding safety holes 150H in a member 150. A locking pin may be inserted in the holes 150H and 148 when the holes are all lined up. This will avoid having the turntable 132 drop if pressure is lost in hydraulic cylinder 138. Note also that a pilot check valve 152 may be used in known fashion to prevent a very rapid pressure loss in the hydraulic cylinder 132C. The operator may of course let go of the handle 146 as soon as the hydraulic cylinder 138 has rotated shafts 134S clear of the hook portion of latches 140. The latches 140 will assume a position further clockwise than the position shown in FIG. 10. Note that the shape of latches 140 allow them to be pushed by contact with shafts 134S to the side when the bracket 134 is moved counterclockwise such that shafts 134S begin to engage the latches 140.

Although various specific instructions have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a longitudinal displacer connected to said grinder support member for moving said grinder support member longitudinally relative to said main frame in a line extending in a front to back direction such that said grindstone grinds in a path extending lengthwise along a rail as said main frame remains stationary; and 'wherein said longitudinal displacer includes a carriage mounted to a carriage track extending in a front to back direction and a carriage mover for moving said carriage along said carriage track; and further comprising a slide frame and wherein said carriage track is part of said slide frame; and further comprising a grinder angle positioner supported by said main frame and operably connected to said grinder support member such that said grinder angle positioner rotates said grinder about a longitudinal axis in the rail to different grinding angles and wherein said slide frame is rotated relative to said main frame by said grinder angle positioner.

2. The rail maintenance vehicle of claim 1 further comprising a feathering actuator for automatically moving said grindstone away from and toward a rail as said grindstone is moved longitudinally respectively away from and toward a center of a weld joint between rail sections.

3. The rail maintenance vehicle of claim 2 wherein said feathering actuator moves said grindstone by moving said slide frame.

4. The rail maintenance vehicle of claim 1, wherein said grinder angle positioner includes an actuator for rotating said grinder to different grinding angles, a drive link connected to said actuator, a first intermediate link connected to said drive link and an output link moved by said first intermediate link such that said output link in turn moves said grinder support member.

5. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a longitudinal displacer connected to said grinder support member for moving said grinder support member longitudinally relative to said main frame in a line extending in a front to back direction such that said grindstone grinds in a path extending lengthwise along a rail as said main frame remains stationary; and wherein said longitudinal displacer includes a carriage mounted to a carriage track extending in a front to back direction and a carriage mover for moving said carriage along said carriage track; and further comprising a feathering actuator for automatically moving said grindstone away from and toward a rail as said grindstone is moved longitudinally respectively away from and toward a center of a weld joint between rail sections; and further comprising a slide frame and wherein said carriage track is part of said slide frame; and further comprising a lateral displacer supported by said main frame and supporting said grinder support member for moving said grinder between right and left positions for grinding respectively on right and left rails, and wherein said slide frame is supported by said lateral displacer.

6. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a longitudinal displacer connected to said grinder support member for moving said grinder support member longitudinally relative to said main frame in a line extending in a front to back direction such that said grindstone grinds in a path extending lengthwise along a rail as said main frame remains stationary; and further comprising a lateral displacer supported by said main frame and supporting said grinder support member for moving said grinder between right and left positions for grinding respectively on right and left rails.

7. The rail maintenance vehicle of claim 6 wherein said longitudinal displacer includes a carriage mounted to a carriage track extending in a front to back direction and a carriage mover for moving said carriage along said carriage track.

8. The rail maintenance vehicle of claim 6 further comprising a slide frame and wherein said carriage track is part of said slide frame.

9. The rail maintenance vehicle of claim 8 further comprising a grinder angle positioner supported by said main frame and operably connected to said grinder support member such that said grinder angle positioner rotates said grinder about a longitudinal axis in the rail to different grinding angles and wherein said slide frame is rotated by said grinder angle positioner.

10. The rail maintenance vehicle of claim 9 wherein said grinder angle positioner rotates said grinder to grinding angles relative to a vertical line centered in a rail having opposite first and second sides extending over a range from at least 95° on the first side of the rail through horizontal to at least 95° on the second side of the rail, and wherein said grinder angle positioner includes an actuator for rotating said grinder to different grinding angles, a drive link connected to said actuator, a first intermediate link connected to said drive link and an output link moved by said first intermediate link such that said output link in turn moves said grinder support member and wherein said output link is attached to said slide frame such that said slide frame moves with said output link.

11. The rail maintenance vehicle of claim 6 further comprising a feathering actuator for automatically moving said grindstone away from and toward a rail as said grindstone is moved longitudinally respectively away from and toward a center of a weld joint between rail sections.

12. The rail maintenance vehicle of claim 6 further comprising a grinder angle positioner supported by said main frame and operably connected to said grinder support member such that said grinder angle positioner rotates said grinder about a longitudinal axis in the rail to grinding angle relative to a vertical line centered in a rail having opposite first and second sides extending over a range from at least 95° on the first side of the rail through horizontal to at least 95° on the second side of the rail.

13. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a longitudinal displacer connected to said grinder support member for moving said grinder support member longitudinally relative to said main frame in a line extending in a front to back direction such that said grindstone grinds in a path extending lengthwise along a rail as said main frame remains stationary; and further comprising:

a turntable support pivotably mounted at a pivot to said main frame for pivoting about a horizontal axis;

a hydraulic turntable cylinder having a first end mounted to said turntable support and a second end;

a turntable base mounted to said second end of said turntable cylinder; and wherein said pivot allows said turntable support to move between:

a lower position wherein said turntable cylinder is vertical for lifting the vehicle upon extension of the turntable cylinder such that the vehicle is turnable about a vertical axis corresponding to said turntable cylinder; and an upper position in which said turntable cylinder is non-vertical.

14. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a grinder angle positioner supported by said main frame and operably connected to said grinder support member such that said grinder angle positioner rotates said grinder about a longitudinal axis in the rail to grinding angles extending over a range from at least 95° on a field side of a rail through horizontal to at least 95° on a gauge side of a rail; and wherein said grinder angle positioner includes an actuator for rotating said grinder to different grinding angles, a drive link connected to said actuator, a first intermediate link connected to said drive link and an output link moved by said first intermediate link such that said output link in turn moves said grinder support member; and further comprising a lateral displacer supported by said main frame and supporting said grinder support member for moving said grinder between right and left positions for grinding respectively on right and left rails.

15. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail; and a grinder angle positioner supported by said main frame and operably connected to said grinder support member such that said grinder angle positioner rotates said grinder about a longitudinal axis in the rail, said grinder angle positioner including an actuator for rotating said grinder to different grinding angles, a drive link connected to said actuator, a first intermediate link connected to said drive link and an output link moved by said first intermediate link such that said output link in turn moves said grinder support member.

16. The rail maintenance vehicle of claim 15 wherein said intermediate link is a T link and further comprising a pair of arm links connected at opposite ends of the T link, and a cross link having opposite ends connected to said arm links, said output link connected to said cross link.

17. A rail maintenance vehicle comprising:

a main frame having a front and a back and four rail engagement wheels supported thereon;

a grinder support member supported by said main frame;

a grinder mounted to said grinder support member, said grinder having a grindstone, a grind motor for rotating the grindstone, and a feed jack for moving the grindstone against and away from a rail;

a lateral displacer supported by said main frame and supporting said grinder support member for moving said grinder between right and left positions for grinding respectively on right and left rails.

18. The rail maintenance vehicle of claim 17 wherein said lateral displacer includes a support frame mounted to said main frame for movement along a lateral track, said grinder support member supported by said support frame, said support frame movable between right and left positions.

19. The rail maintenance vehicle of claim 18 further comprising a longitudinal displacer connected to said grinder support member for moving said grinder support member longitudinally relative to said main frame in a line extending in a front to back direction such that said grindstone grinds in a path extending lengthwise along a rail as said main frame remains stationary, wherein said longitudinal displacer includes a carriage mounted to a carriage track extending in a front to back direction and a carriage mover for moving said carriage along said carriage track, and further comprising a slide frame and wherein said carriage track is part of said slide frame; and wherein said slide frame is supported by said support frame.

20. The rail maintenance vehicle of claim 18 further comprising a grinder angle positioner supported by said main frame and operably connected to said grinder support member such that said grinder angle positioner rotates said grinder about a longitudinal axis in the rail to grinding angles relative to a vertical line centered in a rail having opposite first and second sides extending over a range from at least 95° on the first side of the rail through horizontal to at least 95° on the second side of the rail, said grinder angle positioner connecting said slide frame to said support frame.

21. The rail maintenance vehicle of claim 20 further comprising a feathering actuator for automatically moving said grindstone away from and toward a rail as said grindstone is moved longitudinally respectively away from and toward a center of a weld joint between rail sections.

22. The rail maintenance vehicle of claim 18 further comprising a turntable support pivotably mounted at a pivot to said main frame for pivoting about a horizontal axis; a hydraulic turntable cylinder having a first end mounted to said turntable support and a second end; a turntable base mounted to said second end of said turntable cylinder; and wherein said pivot allows said turntable support to move between: a lower position wherein said turntable cylinder is vertical for lifting the vehicle upon extension of the turntable cylinder such that the vehicle is turnable about a vertical axis corresponding to said turntable cylinder; and an upper position in which said turntable cylinder is non-vertical; and wherein said turntable cylinder and turntable base are sufficiently high when the turntable support is in its upper position that said support frame is movable underneath said turntable cylinder and turntable base.

23. A rail maintenance vehicle comprising:

a main frame having a front and a back and four rail engagement wheels supported thereon;

a workhead support member supported by said main frame;

a workhead for working on a track and mounted to said workhead support member;

a turntable support pivotably mounted at a pivot to said main frame for pivoting about a horizontal axis;

a hydraulic turntable cylinder having a first end mounted to said turntable support and a second end;

a turntable base mounted to said second end of said turntable cylinder; and wherein said pivot allows said turntable support to move between:

a lower position wherein said turntable cylinder is vertical for lifting the vehicle upon extension of the turntable cylinder such that the vehicle is turnable about a vertical axis corresponding to said turntable cylinder; and an upper position in which said turntable cylinder is non-vertical.

24. The rail maintenance vehicle of claim 23 further comprising a lateral displacer supported by said main frame and supporting said workhead support member for moving said workhead between right and left positions for grinding respectively on right and left rails.

25. The rail maintenance vehicle of claim 24 wherein said lateral displacer includes a support frame mounted to said main frame for movement along a lateral track, said workhead support member supported by said support frame, said support frame movable between right and left positions.

26. The rail maintenance vehicle of claim 25 wherein said turntable cylinder and turntable base are sufficiently high when the turntable support is in its upper position that said support frame is movable underneath said turntable cylinder and turntable base.

27. The rail maintenance vehicle of claim 26 wherein said workhead is a grinder mounted to said workhead support member, said grinder having a grindstone, a grind motor for rotating the grindstone, and a feed jack for moving the grindstone against and away from a rail.

28. A rail maintenance vehicle comprising:

a main frame having a front and a back and four rail engagement wheels supported thereon;

a tool support member supported by said main frame;

a tool for changing the profile of a rail mounted to said support member, said tool having a rail contact surface, a motor for causing the rail contact surface to change a rail profile, and a feed jack for moving the rail contact surface against and away from a rail; and a longitudinal displacer connected to said tool support member for moving said tool support member longitudinally relative to said main frame in a line extending in a front to back direction such that side rail contact surface profiles in a path extending lengthwise along a rail as said main frame remains stationary; and wherein said longitudinal displacer includes a carriage mounted to a carriage track extending in a front to back direction and a carriage mover for moving said carriage along said carriage track; and further comprising a slide frame and wherein said carriage track is part of said slide frame; and further comprising a tool angle positioner supported by said main frame and operably connected to said tool support member such that said tool angle positioner rotates said tool about a longitudinal axis in the rail to different angles and wherein said slide frame is rotated relative to said main frame by said tool angle positioner.

* * * * *

UNITED STATES PATENT AND TRADEMARK OFFICE

CERTIFICATE OF CORRECTION

PATENT NO. : 5,359,815

DATED : November 1, 1994

INVENTOR(S) : Schrunk, III et al

It is certified that error appears in the above-indentified patent and that said Letters Patent is hereby corrected as shown below:

Column 14, line 17, (Claim 12, line 6), change "angle" to -- angles --;

Column 18, line 6, (Claim 28, line 14), change "side" to -- said --.

Signed and Sealed this

Twenty-eight Day of February, 1995

*Attest:*

Bruce Lehman

BRUCE LEHMAN

*Attesting Officer*

*Commissioner of Patents and Trademarks*